US005367281A

United States Patent [19]

Crooks

[11] Patent Number: 5,367,281

[45] Date of Patent: Nov. 22, 1994

[54] STRIKER PIN DEVICE FOR AN ELECTRIC FUSE

[75] Inventor: William R. Crooks, Mt. Lebanon, Pa.

[73] Assignee: Eaton Corporation, Cleveland, Ohio

[21] Appl. No.: 175,836

[22] Filed: Dec. 30, 1993

[51] Int. Cl.[5] ..... H01H 37/02; H01H 85/30

[52] U.S. Cl. ..... 337/417; 337/244

[58] Field of Search ..... 337/417, 241, 244, 248, 337/401, 30, 165; 116/105, 217

[56] References Cited

U.S. PATENT DOCUMENTS 2,333,354 11/1943 Andersen .
2,639,350 5/1953 Cox .
4,322,706 3/1982 Thrash ..... 337/417

FOREIGN PATENT DOCUMENTS 1292235 4/1969 Germany ..... 337/244
1161303 8/1969 United Kingdom ..... 337/244

*Primary Examiner*—Leo P. Picard
*Assistant Examiner*—Stephen T. Ryan
*Attorney, Agent, or Firm*—Martin J. Moran

[57] ABSTRACT

A striker pin device for providing a visual indication of an operated condition of an associated fuse, comprising a tubular housing coaxially arranged within the fuse with an end of the housing in contact with an end of the fuse. The tubular housing has a closure structure comprised of a one-piece integrally formed closure member having a projection protruding out of the housing and an opened end with a cavity. A piston with a central projection received in the opened end of the closure member forms a gas tight enclosure containing pyrotechnic material. An ignition element is attached to a brass pin which extends through the projection of the closure member and is connected to a tubular terminal or electrical conductor member which is attached to a high resistance pilot wire, which is stretched through the fuse. The ignition element extends through the pyrotechnic material, between the contacting surfaces of the closure member and the piston, and between the contacting surfaces of the piston and tubular housing for electrical connection between the ignition element and the housing. Ignition of the pyrotechnic material drives the piston and striker pin toward the opposite end of the housing to cause the striker pin to pierce the fuse cap thereby providing the visual indication of the operated condition of the fuse, the pyrotechnical material being ignited upon rupture of the low resistance fusible elements by the resulting flow of the shunt current through the electrically connected elements of the striker pin device.

15 Claims, 2 Drawing Sheets

STRIKER PIN DEVICE FOR AN ELECTRIC FUSE

BACKGROUND OF THE INVENTION

1. Field of the Invention

This invention relates to a striker pin device mounted inside a totally enclosed fuse structure and arranged to pierce one end of the fuse structure upon operation of the fuse thereby to provide a visual indication of the operated condition of the fuse or so as to actuate an auxiliary device such as a switching device.

2. Background of Information

One known type of a fuse striker device is of the spring actuated type wherein a striker pin is seated on a compressed spring that is held in compressed condition by a high resistance strain wire which is electrically connected in shunt with the fuse links. Upon rupture of the fuse links this wire is quickly melted by the current shunted through it. Melting of the high resistance strain wire results in the release of the pin which protrudes through the end of the fuse to provide an indication of the operated condition of the fuse or to actuate a signal or switching device.

Objections to the spring actuated type of striker assembly are due to the high costs and large physical dimensions thereof.

Another known fuse striker is of the so-called pyrotechnic or powder-actuated type wherein a powder charge is ignited by an ignition element to actuate piston means and thus to drive the striker pin into its operated condition.

The disadvantages of the powder actuated device center primarily around the fact that such mechanisms must be constructed with close tolerances to prevent the escape of piston actuating gases. Such constructions are particularly costly and are vulnerable to rough handling since the ignition element is usually high resistance fragile wire which is easily damaged because of its brittle nature.

Another known pyrotechnic or powder-actuated fuse striker is disclosed in U.S. Pat. No. 4,322,706 issuing on Mar. 30, 1982. In the device of U.S. Pat. No. 4,322,706 a striker housing comprising two or more complementary mating sections with a longitudinal groove formed in the face of at least one mating section receives a fragile elongated ignition element. The mating sections effectively close one end of the housing rendering it substantially gas tight. A piston slideable within the housing is operated by pyrotechnic material. The piston has a cup-like configuration with an outwardly flared lip portion which substantially eliminates leakage of propulsion gases between the piston and the housing wall without requiring close machining tolerances for the flared piston and for the inner surface of the housing.

A main disadvantage of the striker pin device disclosed in U.S. Pat. No. 4,332,706 is the fact that the ignition element must be securely fastened to the contact and the contact plate which are, in turn, welded to the bottom of the cup-like piston. As these elements are usually diminutive, the assembly of these components in the cup-like piston oftentimes is difficult in that the cup-like piston provides an extremely small space in which to work.

SUMMARY OF THE INVENTION

The invention is a striker pin device that obviates or at least ameliorates the aforementioned shortcomings of the prior art by providing an improved design for an enclosure assembly for carrying pyrotechnic material and for arranging the ignition element in the enclosure assembly such that it extends out of the enclosure assembly and between the contacting surfaces of the inner wall of the main housing of the device and the striker pin for electrical contact of the ignition element with the main housing of the device.

The enclosure assembly of the present invention comprises a closure member, which is preferably of a one-piece integral construction having a projecting end with an aperture and extending through one end of the tubular housing of the striker pin device and an opened end portion communicating with a cavity, and a piston with a central projection received in the opened end portion of the closure member for forming an enclosure containing pyrotechnic material. A brass pin with an enlarged head is inserted inside the enclosure into the aperture of the closure member. Preferably, the end of the ignition element is wound around the brass pin and is captured between the enlarged head of the pin and an inner wall of the closure member forming the enclosure, and the other end of the ignition element is trapped between the mating surfaces of the piston and the closure member and the mating surfaces of the piston and the striker pin with the inner wall of the housing of the device which arrangement electrically connects the ignition element to the housing. An electrically conductive tubular member is attached to the end of the brass pin extending out of the housing and a coil of wire is attached, preferably by crimping the tubular member, to the tubular member. For installation into the fuse, the striker pin device is inserted into the fuse housing with the one end of the pin device housing contacting the fuse housing and the coil of wire being longitudinally stretched inside the fuse housing for its contact with the other end of the fuse housing.

It is, therefore, an object of the present invention to provide a striker pin device for a fuse which is easy to assemble assuring that the ignition element is fixedly secured for the completion of an electrical circuit for shunt purposes in a fuse.

It is a further object of the invention to provide close tolerances between a piston and its housing of a striker pin device therefore guaranteeing a substantially gas tight seal between the piston and the housing for operation of the striker pin.

A further object of the invention is to provide a unique design for an enclosure assembly containing pyrotechnic material and a unique means for terminating the ends of an ignition element to reliably cause ignition of the pyrotechnic material for operation of the striker pin within the striker pin device.

These and other objects of the present invention will be more fully understood and appreciated from the following description of the invention on reference to the illustrations appended herein.

DESCRIPTION OF THE PREFERRED EMBODIMENT

Figure 1:
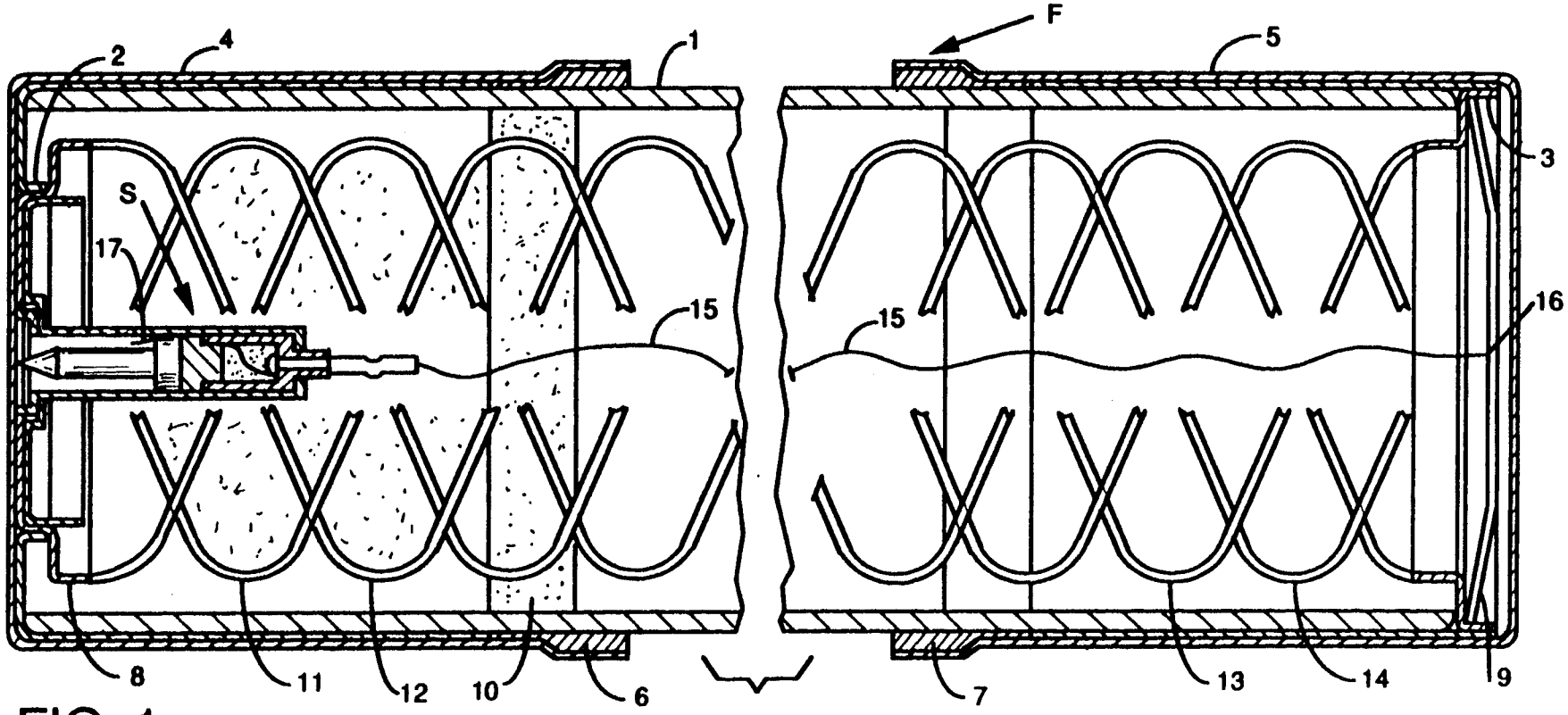
FIG. 1 is a cross-sectional view of an electric fuse and a fuse striker pin device installed therein and formed according to a preferred embodiment of the present invention.

The present invention is an improvement to a striker pin device for use in a fuse element similar to that disclosed in the aforementioned U.S. Pat. No. 4,322,706, which is incorporated herein by reference.

In the figures, the numeral 1 designates a tubular housing for fuse F and is formed of insulating material. End caps 2 and 3 are disposed at opposite ends of the tubular housing 1 and are formed of suitable conducting material. Outer caps 4 and 5 are secured about the end caps 2 and 3 respectively by a pressed fit, and the end caps 2 and 3 are secured to the tubular housing 1 generally by means of a pressed fit with a curing material along the fanged portions indicated at 6 and 7. End terminal ring 8 is secured to inner cap 2 and is disposed within a central aperture formed within cap 2. End terminal ring 9 is concentrically located within cap 3 and is made a part of cap 3. The housing structure 1 is filled with silica sand 10 which preferably is in the form of approximately spherically shaped grains of graded size within a given range.

Disposed within the housing 1 of the fuse F and embedded within and supported by the granular filler 10 are a plurality of helical fusible elements 11–14. As is apparent from FIG. 1, these helical elements 11–14 are arranged with their ends connected with the terminal rings 8 and 9 respectively. Rings 8 and 9 together with caps 4 and 5 constitute terminal elements for the fuse F.

In accordance with this invention in one form striker pin device S is mounted within the fuse F in abutting contact with cap 4 at its left hand end and is connected at its right hand end with a high resistance wire 15, the right hand end of which is electrically connected at 16 with cap 5. Since the wire 15 is of high resistance and because the fusible elements 11–14 are of low resistance, the current through the fuse F is conducted under normal conditions by the fusible elements 11–14. When these elements are melted, the line voltage is applied across the high resistance wire 15 and consequently creates a current through the ignition element 17 and through the conducting parts of striker assembly S to operate striker assembly S, more about which will be discussed hereinbelow.

Figure 2:
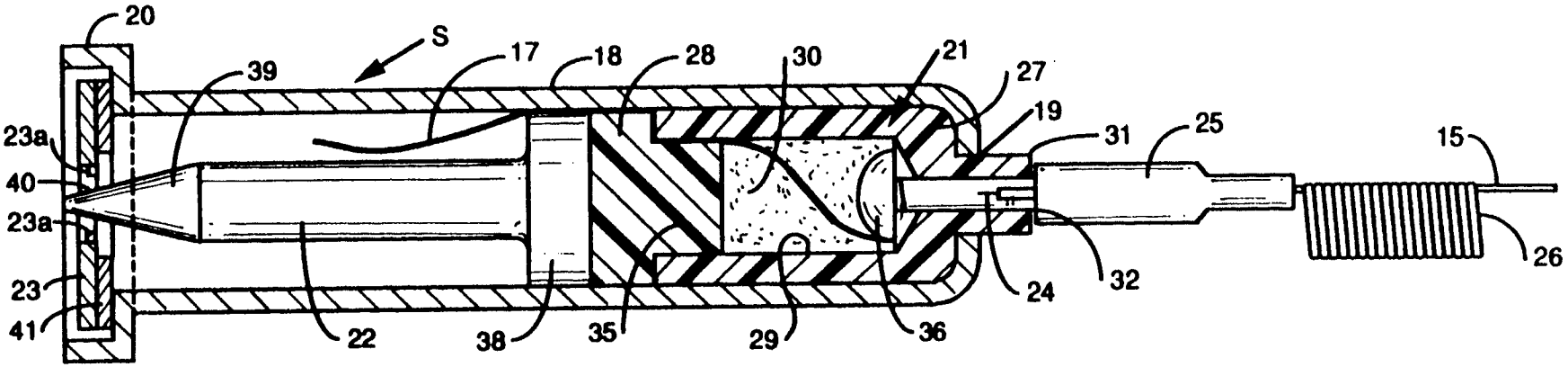
FIG. 2 is an enlarged cross-sectional view of the striker pin device shown generally in FIG. 1 and with the striker pin in its normal unoperated condition.
Figure 3:
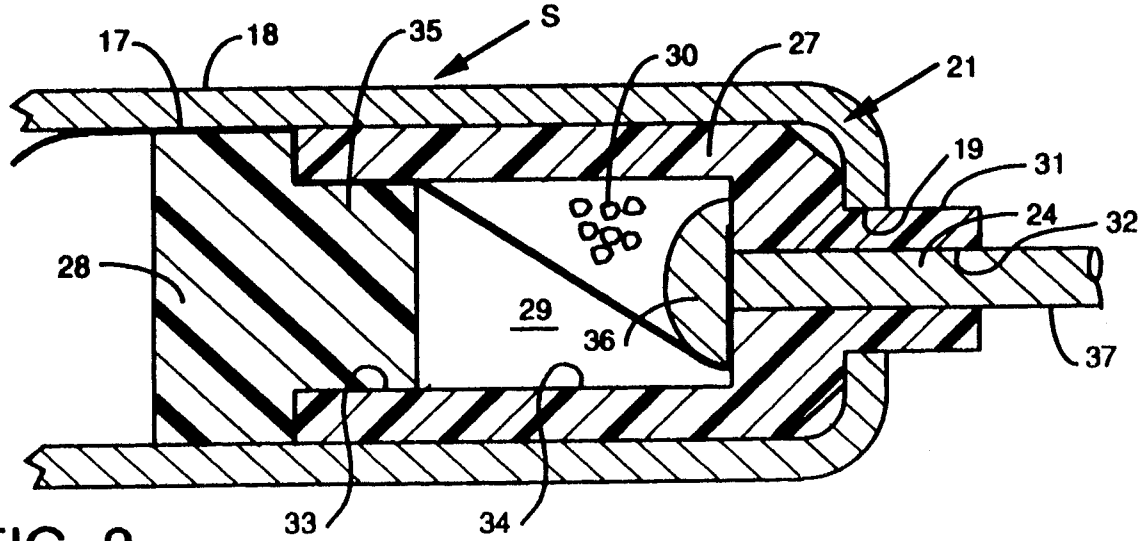
FIG. 3 is an enlarged, partial cross-sectional view of FIG. 2 illustrating the attachment and arrangement of an ignition element in exaggerated form in the enclosure assembly of the present invention.

As is best shown in FIGS. 2 and 3, striker pin device S includes a tubular housing 18, which preferably is made of a conductive material such as brass, and which has an aperture 19 at its one end as indicated to the right of FIGS. 2 and 3 and which is outwardly flanged at its other end as indicated at 20 to the left of FIG. 2.

Referring particularly to FIG. 2, the striker pin device S is basically comprised of an enclosure assembly 21, striker pin 22, retainer ring 23, pin member 24 in enclosure assembly 21, an electrically conductive tubular connector 25, a pilot wire 26 shown in FIG. 2 in coil form, and the aforesaid ignition element 17.

Enclosure assembly 21 is located near the end of tubular housing 18 which contains aperture 19, and in accordance with a feature of the invention enclosure assembly 21 includes a closure member 27 and piston 28 which cooperate together to form an enclosure area 29 for containing pyrotechnic material 30 therein.

As best shown in FIG. 3, closure member 27 has a projecting end portion 31 with an aperture 32 and an opened end portion 33 with an adjacent communicative cavity 34 by which enclosure 29 is formed. The projecting end portion 31 is pressed into and snugly received in aperture 19 of housing 18, which is made of a conductive material, and preferably, brass. Aperture 32 is opened to the environment and communicates with enclosure 29 of closure member 27.

As best shown in FIGS. 2 and 3, piston 28 has a central projection portion 35 which is fitted into and snugly received in opened end portion 33 of closure member 27. Very close tolerances or a snug fit between the mating or contacting surfaces of closure member 27 with piston 28 is preferable in order to retain one end of ignition dement 17 therebetween. The other end of ignition dement 17 is secured by wrapping it several times around brass pin 24 which is press fit and snugly received in aperture 32 of closure member 27. This is best shown in FIG. 3 which also illustrates that pin 24 has an enlarged head portion 36 which is located in enclosure 29 and an end 37 which extends out of housing 18 along with projecting end portion 31 of closure member 27.

As the one end of ignition element 17 is fixedly secured to pin 24, which preferably is brass, the opposite end of ignition element can be pulled taut and held in place between the contacting surfaces of closure member 27 and piston 28, resulting in ignition element 17 extending lengthwise in enclosure 29 and embedded in the pyrotechnic material 30 as shown in the figures.

Ignition element 17, which is generally a flat, fragile high resistance wire, is preferably formed of tungsten and is approximately three thousandths of an inch in diameter, thus allowing it to be secured in enclosure 29 (FIG. 3) in the manner discussed hereinabove.

Referring particularly to FIG. 2, ignition element 17 is electrically connected to pilot wire 26 by the expedient of connecting tubular connector 25 to the end of pin 24 by welding or press fitting and mechanically crimping or clamping pilot wire 26 at the other end of tubular connector 25 as best shown in this figure.

Closure member 27 and piston 28 are preferably made of an insulating material which may be a plastic, such as nylon, or any suitable elastomeric or polymeric material, and preferably are each of a one piece integral construction, made either by injection molding or by a machining operation.

Still referring particularly to FIG. 2, striker pin 22 is located adjacent to and in abutting relationship with piston 28. Striker pin 22 may be made of steel and comprises an enlarged base portion 38 and a small spindle portion 39 having a point 40 at its end shown to the left in FIG. 2.

In accordance with another feature of the invention ignition element 17 extends between the mating surfaces of the enlarged base portion 38 and the inner wall of tubular housing 18 with its end possibly extending in tubular housing 18 alongside striker pin 22 as particularly shown in FIG. 2.

Retainer ring 23 in flange 20 of housing 18 is secured to the face of washer 41. Washer 41 preferably has an inner diameter slightly greater than the outer diameter of the body of pin 22 so that pin 22 can move through washer 41 upon the explosion of the material 30 until the base portion 38 of pin 22 abuts washer 41. Preferably, retainer ring 23 has a series of teeth around its inner diameter as indicated at **23*a*. These teeth help to lessen the chances of pin 22 travelling back into housing 18** after the explosion occurs.

Piston 28 is dimensioned to provide a light press fit into closure member 27, and both piston 28 and closure member 27 are dimensioned to provide a light press fit into the bore of housing 18. Additionally, closure member 27 is shaped to provide an electrical insulation between pin 24 and housing 18, and as stated hereinabove, both closure member 27 and piston 28 are made of an insulating material, such as plastic.

In assembling striker pin device S, the following operation is undertaken; ignition element 17 is wound around pin 24 behind its enlarged head 36. Pin 24 is pressed fitted through aperture 32 in closure member 27, thus capturing or trapping ignition element 17 under the enlarged head 36 of pin 24.

A measured amount of pyrotechnic material about 70 milligrams, which may be of a low grade, black gun powder type or equivalent pyrotechnic material, such as Pyrodex P® made by Hodgedon Powder Co., Kansas, available commercially, is placed into enclosure 29 of closure member 27 which is then sealed by piston 28 to form enclosure assembly 21. This operation traps ignition wire 17 between mating and contacting surfaces of closure member 27 and piston 28, leaving a relatively short length of ignition element 17 exposed.

The enclosure assembly 21 is then inserted into housing 18 as shown in FIG. 2 thus positively trapping ignition element 17 between the contacting surfaces of piston 28 and the inner wall of housing 18, thereby providing a positive electrical connection of the ignition element 17 with metal housing 18, and completing an electrical circuit between metal pin 24 connected to tubular connector 25 and pilot wire 26 and housing 18, with ignition wire 17 passing through the pyrotechnic material 30 in enclosure 29 of the enclosure assembly 21.

The insertion of enclosure assembly 21 is followed by the insertion of striker pin 22, washer 41, and retainer ring 23 for its unoperated condition shown in the figures. The striker pin 22 is inserted in housing 18 such that ignition element 17 may extend between the contacting surfaces of the inner wall of housing 18 as shown in FIG. 2 and alongside striker pin 22.

When striker pin device S is installed in the fuse of FIG. 1, the coiled pilot wire 26 of FIG. 2 is stretched in the fuse for its connection to end cap 5 of FIG. 1.

An excessive current which causes the fusible elements 11–14 to melt causes a current to flow through the high resistance wire 26 which is sufficient to heat the tungsten ignition wire 17 sufficiently to ignite the pyrotechnical material 30. This action establishes pressure in the enclosure 29 of enclosure assembly 21, which pressure drives piston 28 toward the left in the figures and causes striker pin 22 to move from the position represented in the figures to a position which pierces the end cap 4. The striker point 40 thereafter projecting through end cap 4 about ⅜ inch is observable and indicates that the fuse has operated. Of course, striker pin 22 may serve by known procedures to actuate some other signal device or a switching or micro-switching device, if desired.

As can be appreciated from the above, ignition element 17 which conventionally is tungsten wire which is of a fragile and brittle construction is not physically but is electrically connected through brass pin 24 and metal tubular connector 25 to strain wire 26 which conventionally may be made of copper-nickel material which is more durable than tungsten to endure the rough handling of the striker pin device S during its installation and operation in fuse F of FIG. 1.

Whereas particular embodiments of the invention have been described above for purposes of illustration, it will be appreciated by those skilled in the art that numerous variations of the details may be made without departing from the invention as described in the appended claims.

In accordance with the provisions of the patent statutes, we have explained the principles and operation of our invention and have illustrated and described what we consider to be the best embodiments thereof.

What is claimed:

1. A striker pin device for an electric fuse, comprising:

a tubular electrically conductive housing, a one-piece integrally formed closure member disposed in said tubular housing and having a projecting end portion extending through a first end of said housing and an opened end portion and a cavity communicating with said opened end portion, piston means having a central projection received in said opened end portion of said closure member for forming an enclosure with said cavity of said closure member, a striker pin disposed in said housing adjacent to said piston means and arranged to move toward a second end of said housing in coordination with operating movement of said piston means, pyrotechnic material disposed within said enclosure formed by said closure member and said piston means, electrically conductive pin means projecting through said projecting end portion of said closure member and protruding through said tubular housing, an elongated ignition element secured to said pin means, extending through said pyrotechnic material in said enclosure, and interposed between abutting surfaces of said closure member and said piston means and between contacting surfaces of an inner wall of said housing and an outer wall of said piston means for an electrical connection of said ignition element to said housing, and means for electrically activating said ignition element for igniting said pyrotechnic material, thereby imparting said operating movement of said piston means and said striker pin to said second end of said tubular housing.

2. A device of claim 1, wherein said closure member and said piston means are formed of a suitable electrically insulating material.

3. A device of claim 1 wherein said closure member and said piston means are injected molded, and made of a polymer material.

4. A device of claim 1, wherein said closure member and said piston means are machined.

5. A device of claim 1 wherein said means for electrically activating said ignition element further comprises:

an electrical tubular conductor member connected at said first end to said pin means and disposed externally of said tubular housing, and high resistance pilot wire means attached to said second end of said conductor member for electrical circuitry connection to said pin means and said ignition element secured to said pin means and to said fuse.

6. A device of claim 5 wherein said high resistance pilot wire means is made of copper nickel.

7. A device of claim 1 wherein said ignition element is made of tungsten.

8. A device of claim 1, wherein said pin means is made of brass.

9. A device of claim 1, wherein said tubular housing is made of brass.

10. A striker pin device for an electric fuse, said device comprising:

an electrically conductive tubular housing, a closure member for a first end of said housing, piston means disposed in said housing and cooperating with said closure member to form a substantially gas tight enclosure, a striker pin disposed within said housing and arranged to move toward a second end thereof in coordination with operating movement of said piston means, pyrotechnic material disposed in said enclosure formed by said closure member and said piston means, an elongated ignition element extending through said pyrotechnic material in said enclosure, and means for activating said ignition element including means for disposing said ignition element outside of at least said piston means in current carrying contact with the inner wall of said tubular housing and means for electrically connecting said ignition element externally of said tubular housing for igniting said pyrotechnic material, thereby imparting said operating movement of said piston means within said tubular housing.

11. A device of claim 10, wherein said closure member has a projecting end portion extending out of said first end of said housing and an opened end portion for forming said enclosure with said piston means.

12. A device of claim 11, wherein said projecting end portion has aperture means, and wherein said means for electrically connecting said ignition element externally of said tubular housing comprises:

electrically conductive pin means disposed in said closure member and securely extending out through and fixed in said aperture means to form a substantially gas tight seal therebetween, said pin means having means disposed in said enclosure in contact with an inner wall of said closure member for fixedly securing said first end of said ignition element in said enclosure.

13. A device of claim 12, wherein said pin means is formed of brass material and wherein said means of said pin means for fixedly securing said ignition element in said enclosure consists of an enlarged head portion at said first end of said pin means.

14. A device of claim 12, wherein said piston means has a central projecting end portion received in said opened end portion of said closure member for said forming of said enclosure by the mating surfaces thereof, and wherein said ignition element is electrically connected to said inner wall of said tubular housing by interposing the other end of said ignition element between the mating surfaces of said closure member and said piston means and the mating surfaces of at least said piston means with said inner wall of said tubular housing.

15. A device of claim 11, wherein said means for electrically connecting said ignition element externally of said tubular housing further comprises:

electrically conductive tubular means connected to the end of said pin means extending out of said aperture means of said closure member, and high resistance pilot wire means attached to said tubular means and extending through said electric fuse and in contact with said electric fuse.

* * * * *